US006057000A

United States Patent [19]

Cai

[11] Patent Number: 6,057,000

[45] Date of Patent: May 2, 2000

[54] EXTRUSION COATING PROCESS

[75] Inventor: Jian Cai, Penfield, N.Y.

[73] Assignee: Xerox Corporation, Stamford, Conn.

[21] Appl. No.: 09/182,087

[22] Filed: Oct. 29, 1998

[51] Int. Cl.[7] ..... B05D 3/12

[52] U.S. Cl. ..... 427/358; 427/356; 425/461; 118/410

[58] Field of Search ..... 425/461; 427/358, 427/356; 118/410

[56] References Cited

U.S. PATENT DOCUMENTS

| | | | |
|---|---|---|---|
| 4,285,655 | 8/1981 | Matsubara | 425/461 |
| 4,332,759 | 6/1982 | Ide | 264/108 |
| 4,521,457 | 6/1985 | Russell et al. | 427/286 |
| 4,990,293 | 2/1991 | Macosko et al. | 264/40.1 |
| 5,234,330 | 8/1993 | Billow et al. | 425/461 |
| 5,516,557 | 5/1996 | Willnow et al. | 427/358 |
| 5,614,260 | 3/1997 | Darcy | 427/277 |

OTHER PUBLICATIONS

Mechanics of Polymer Processing by J.R.A. Pearson, 1985 (no month date).

*Primary Examiner*—Katherine A. Bareford

[57] ABSTRACT

A coating process including providing a coating composition comprising finely divided photoconductive organic particles dispersed in a solution of a film forming binder, the composition having a predetermined substantially constant liquid yield stress value, flowing the composition along a feed channel, introducing the composition into an elongated manifold cavity comprising a least a first progressively narrowing channel extending away from the feed channel, flowing the coating composition along at least the first progressively narrowing channel, flowing the coating composition out of the manifold cavity into an extrusion passageway extending away from at least the first progressively narrowing channel, shaping the coating composition into a thin ribbon shaped stream in the extrusion passageway, depositing the ribbon shaped stream on a substrate to form a coating, and maintaining an applied shear stress to the composition that is greater than the yield shear stress value of the coating composition while flowing the composition through the at least first progressively narrowing channel and extrusion passageway.

19 Claims, 6 Drawing Sheets

EXTRUSION COATING PROCESS

BACKGROUND OF THE INVENTION

This invention relates to a process for applying a coating dispersion to a surface of a support member and more specifically to an extrusion or slot coating process for applying a ribbon-like stream of coating material to a substrate.

Numerous techniques have been devised to form a layer of a coating composition on a substrate. One of these techniques involves the use of an extrusion die from which the coating composition is extruded onto the substrate. For fabrication of web type, flexible electrophotographic imaging members, the extrusion die must lay down very thin coatings meeting extremely precise, critical tolerances in the single or double digit micrometer ranges. During the extrusion or slot coating of thin layers, the window of operating parameters is extremely small and are affected by factors such as coating thickness, speed of substrate, Theological properties of coating liquids, vacuum pressure, relative speed of the ribbon of coating material, pressure applied to the coating material as it progresses through an extrusion nozzle, and the like.

Extrusion techniques for forming thin layers are known and described, for example in U.S. Pat. No. 4,521,457 and U.S. Pat. No. 5,614,260, the entire disclosures thereof being incorporated herein by reference. The extrusion die usually comprises spaced, walls or lands, each having a flat surface parallel to and facing the other. These spaced lands form a narrow, elongated, extrusion passageway having an entrance slot at one end and an exit slot at the opposite end of the passageway. The passageway normally has side walls to direct the flow of a thin ribbon shaped stream of coating composition. Generally, the coating composition is supplied by a reservoir or manifold positioned along the length of the entrance slot of the extrusion passageway. The coating composition liquid travels from a pump through a feed channel, such as a pipe, to the manifold of the extrusion die. The coating composition liquid is distributed by the manifold into the entrance slot of the extrusion passageway. The coating composition liquid then travels through the extrusion passageway and out the exit slot onto a substrate to be coated. A typical photoreceptor extrusion die manifold has a cavity in the shape of a cylinder having a straight imaginary axis. This cylindrical cavity has a constant cross sectional area from one end of the cavity to the opposite end. The feed channel or feed pipe is connected to the manifold cavity midway between the opposite ends of the cavity. The feed channel has an imaginary axis which is perpendicular to the imaginary axis of the cylindrical manifold cavity to form a "T" shaped configuration. The coating composition liquid supplied by the feed channel is distributed by the manifold to an extrusion passageway connected to the manifold. The extrusion passageway conveys the coating material liquid from the manifold and shapes it into a thin ribbon-like extrudate which is thereafter deposited as a coating onto a substrate. After various layers are deposited, the coated photoreceptor web is subsequently sliced to form rectangular sheets which are formed into a belt type photoreceptor by welding opposite ends of the sheet together.

Generally, variations in pressure applied to a charge transport layer coating solution as it progresses through an extrusion coating system does not affect the quality of the final coating significantly. Similarly, many dispersions such as inorganic particles (e.g., trigonal selenium particles) dispersed in a solution of film forming binder material are not affected by variations in pressure applied to it as the dispersion progresses through an extrusion coating system. When a conventional extrusion die is utilized for forming very thin coatings of dispersions of organic photoconductive particles, it has been found that defects resembling brush marks often appear along each edge of the deposited coating. These brush marks remain as defects in the dried coating and ultimately print out as undesirable artifacts in the final electrophotographic copy.

The coating materials for the charge generation layer of the photoreceptors are made of dispersions. The dispersion is non-Newtonian, which shows behaviors of shear thinning, thixotropy, and yield stress. The dispersion shows little or no deformation up to the yield stress. This leads to flocculation of dispersion particles and defects in the coated film.

INFORMATION DISCLOSURE STATEMENT

U.S. Pat. No. 5,516,557 to Willnow et al., issued May 14, 1996—A Process is disclosed for forming a coating from a flocculating coating composition containing pigment particles dispersed in a solution of a film forming binder dissolved in a fugitive liquid carrier, maintaining the coating composition in average shear conditions of at least about 10 reciprocal seconds while transporting the coating composition through an inlet of an extrusion die, through a manifold of the die and onto a substrate to form a coating layer on the substrate, and rapidly removing the fugitive liquid from the coating while maintaining the coating composition in the coating layer in an undisturbed condition until the coating solidifies.

U.S. Pat. No. 4,521,457 to Russell et al., issued Jun. 4, 1985—A process is disclosed in which at least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member.

U.S. Pat. No. 5,614,260 to Darcy, issued Mar. 25, 1997—A process is disclosed for applying to a surface of a support member at least one ribbon-like stream of a first coating composition side-by-side with at least one ribbon-like stream of a second coating composition comprising providing an extrusion die source for the ribbon-like stream of the first coating composition, providing a slide die source for the ribbon-like stream of the second coating composition, establishing relative motion between the surface of the support member and the source of the ribbon-like streams, simultaneously and continuously applying the ribbon-like streams to the surface of the support member whereby the ribbon-like streams extend in the direction of relative movement of the surface of the support member and the sources of the ribbon-like streams to form a continuous unitary layer having a boundary between the side-by-side ribbon-like streams on the surface of the support member and drying the continuous unitary layer to form a dried coating of the first coating composition side-by-side with a dried coating of the second coating composition. This process may be carried out with apparatus comprising an extrusion die attached to and supporting a slide die, the extrusion die being adapted to applying to a surface of a support member at least one ribbon-like stream of a first coating composition and the slide die being adapted to apply to the surface a ribbon-like stream of a second coating composition side-by-side to and in edge contact with the ribbon-like stream of the first coating composition.

*MECHANICS OF POLYMER PROCESSING*, J. R. A. Pearson, Elsevier Applied Science Publishers Ltd., London and New York, pp 207–211, 1986.

The characteristics of prior photoreceptor coating layer extrusion systems exhibit deficiencies for fabricating photoreceptors meeting precise uniform coating requirements.

SUMMARY OF THE INVENTION

It is an object of this invention to overcome the above noted deficiencies by providing an improved process for fabricating photoreceptor coatings using dispersions of coating material.

It is another object of this invention to provide an improved process for extrusion coating or slot coating of dispersion coating compositions to form a coating having uniform thickness.

It is yet another object of this invention to provide an improved process for extrusion coating or slot coating of dispersion coating compositions to form a coating free of brush marks.

It is still another object of this invention to provide an improved process for extrusion coating or slot coating of dispersion coating compositions to form a coating with fewer defects in the dried coating.

It is a further object of the invention to provide a coating process comprising for extrusion coating or slot coating of dispersion coating compositions to form a photoreceptor which does produce undesirable artifacts in the final electrophotographic Copy.

It is another object of this invention to provide an improved process for extrusion coating or slot coating of dispersion coating compositions.

It is yet another object of this invention to provide a quantitative way to design coating die for dispersion coating.

It is still another object of this invention to provide an improved process for extrusion coating or slot coating of dispersion coating compositions using a feed pipe and a coating die that delivers a coating composition comprising finely divided photoconductive organic particles dispersed in a solution of a film forming binder, onto a substrate and form a film which is uniform and free of defects.

It is still another object of this invention to provide an improved process for extrusion coating or slot coating of dispersion coating compositions where the dispersion is maintained under shear conditions in the feed pipe and most of the inside of a die, the minimal wall shear stress being maintained greater than the dispersion yield stress so that no flocculation's or aggregations of pigment particles appear in the manifold cavity, extrusion passageway, or slot during the coating operations.

The foregoing objects and others are accomplished in accordance with this invention by a process comprising providing a coating composition comprising finely divided photoconductive organic particles dispersed in a solution of a film forming binder, the composition having a predetermined substantially constant liquid yield stress value flowing the composition along a feed channel, introducing the composition into an elongated manifold cavity comprising a least a first progressively narrowing channel extending away from the feed channel, flowing the coating composition along at least the first progressively narrowing channel, flowing the coating composition out of the manifold cavity into an extrusion passageway extending away from at least the first progressively narrowing channel, shaping the coating composition into a thin ribbon shaped stream in the extrusion passageway, depositing the ribbon shaped stream on a substrate to form a coating, and maintaining an applied shear stress to the composition that is greater than the yield shear stress value of the coating composition while flowing the composition through the at least first progressively narrowing channel and extrusion passageway.

This process may be employed to coat the surface of support members of various configurations including webs, sheets, plates, drums, and the like. The support member may be flexible, rigid, uncoated, precoated, as desired. The support members may comprise a single layer or be made up of multiple layers.

BRIEF DESCRIPTION OF THE DRAWINGS

A more complete understanding of the process and apparatus of the present invention can be obtained by reference to the accompanying drawings wherein.

The figures are merely schematic illustrations of the present invention. They are not intended to indicate relative size and dimensions of actual dies.

DESCRIPTION OF THE PREFERRED EMBODIMENTS

Figure 1:
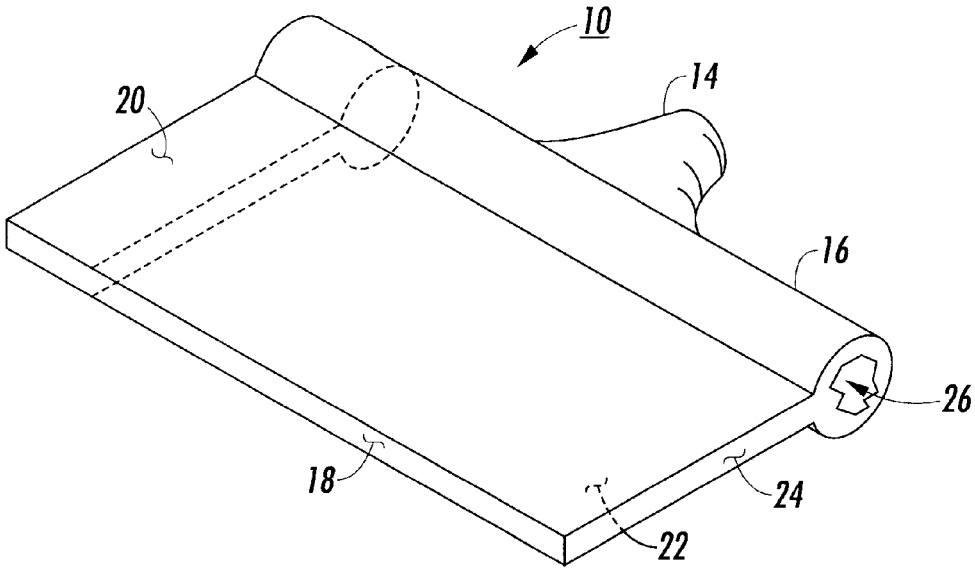
FIG. 1 Prior Art
FIG. 1 is a schematic, isometric view of prior art extrusion system in which a ribbon-like stream of a coating composition is formed.

Referring to FIG. 1, a prior art extrusion die body designated by the numeral 10 is illustrated. Extrusion dies are utilized for extrusion of coating compositions onto a support. Extrusion dies are well known and described, for example, in U.S. Pat. No. 4,521,457, the entire disclosure thereof being incorporated herein by reference. Die body 10 usually comprises an upper and lower half (not shown) held together with conventional clamping flanges (not shown) such as illustrated in U.S. Pat. No. 4,521,457. Die body 10 comprises a feed channel 14, a manifold 16, and an extrusion passageway 18 defined by flat upper land 20, flat lower land 22 and side plates 24. Manifold 16 has a cavity 26 which is cylindrical in shape. The surfaces of flat upper land 20 and flat lower land 22 which define passageway 18 are spaced from and parallel to each other. The leading edge and the trailing edge of passageway 18 are straight and parallel to each other. The cross sectional area of the cavity 26 is constant from one end of the manifold 16 to the opposite end. In other words, the diameter of cavity 26 remains unchanged from one end of manifold 16 to the opposite end. Since cavity 26 has a cylindrical shape, the cavity has an imaginary axis that is straight. The imaginary axis of the essentially circular cross section of feed channel 14 is perpendicular to the imaginary axis of cavity 26 to form a "T" shape. The coating material is introduced into manifold 16 through feed channel 14. Feed channel 14 is positioned midway between the ends of manifold 16. Manifold 16 substantially uniformly distributes the coating material along the entire width of the entrance at the upstream end of extrusion passageway 18. Extrusion passageway 18 shapes the coating composition into a thin ribbon shaped stream which exits from the downstream end of the extrusion passageway. The ribbon shaped stream of coating material exiting from passageway 18 thereafter deposits on a substrate (not shown) to form a coating.

When a conventional "T" shaped extrusion die such as the one illustrated in FIG. 1 is utilized for forming very thin coatings of charge transport layer coating materials or certain charge generating layer dispersion material such as trigonal selenium particles dispersed in a solution of a film forming binder, the coatings formed are quite satisfactory. It has been found that, generally, the flow of solutions of charge transport layer coating material is Newtonian so that the viscosity undergoes very little change. In other words, the variation in the shear viscosity is substantially unchanged with the variations in applied shear rate for Newtonian coatings compositions. Thus, variations in pressure applied to the charge transport layer coating material as it progresses through an extrusion coating system does not affect the final coating significantly. Similarly, many dispersions such as inorganic particles (e.g., trigonal selenium particles) dispersed in a solution of film forming binder material are not affected by variations in pressure applied to it as the dispersion progresses through an extrusion coating system. However, when certain other charge generating layer dispersion material such as organic photoconductive particles dispersed in a solution of a film forming binder are extruded from a "T" shaped extrusion die similar to that illustrated in FIG. 1 to form very thin coatings, defects resembling brush marks, nonuniformity, and wavy patterns often appear along each edge of the deposited coating. These non-uniformity, wavy patterns, and brush marks remain as defects in the dried coating and ultimately print out as undesirable artifacts in the final electrophotographic copy. It was discovered that defective coatings where formed with the "T" shaped extrusion die when the dispersions used exhibited a substantially constant yield stress value. Unlike Newtonian liquids, these constant yield stress dispersions with a yield stress undergo significant variations in viscosity when subjected to variations in shear rate fluctuations in pressure applied to it as the dispersion progresses through a "T" shaped extrusion coating system. These fluctuations in applied pressure appear to be due to the formation of vortices, eddies and the like. These dispersions of organic photoconductive pigment particles in a solution of film forming binder material show little or no deformation up to a certain threshold value of the applied finite shear stress. This threshold value is defined as the "yield stress value". Normally, the yield stress value for any specific dispersion is "substantially constant" from each measurement. The yield stress may increase if the same dispersion is under shear for several measurement cycles due to changes of floc or aggregation structure. i.e., varies due to slight nonuniformities in dispersion concentration in different locations of the coating composition. When the applied shear stress exceeds this yield stress value, the dispersion flows readily. The shear stress and yield stress value are measured in "Pascal" or "dyne per square centimeter" units from most rheometers. The yield stress value for any specific dispersed organic photoconductive pigment coating composition can be measured by a stress rheometer with a double Couette geometry. A typical stress rheometer is Stress Tech, available from ATS RheoSystems. Thus, for the extrusion coating of charge generating layer coating compositions containing dispersed organic photoconductive pigment particles, the effect of variations in shear stress applied to the liquid can adversely affect the quality of the final coating. It is believed that "dead" spots are formed at the two ends in a "T" shaped die where vortexes form to allow the shear stress applied to the dispersion to drop below a critical point, i.e. below the yield stress value of the dispersion. Generally, laminar flow is maintained throughout the extrusion die including the manifold region. The applied shear stress for all regions of the coating material in the extrusion die should be maintained above the yield stress value for the coating composition being employed. When the applied shear stress to all regions of the coating composition in the extrusion die is maintained above the yield stress value, exceptional uniformity of the liquid is achieved with a proper design of the coating die and the streaks along the edges of the deposited coating are avoided. It is believed that these streaks are due to flocculation when the shear stress applied to portions of the coating material in the extrusion die drops below the yield stress value of the dispersion in some or all regions of the dispersion. Although conventional "T" shaped extrusion dies are very simple to fabricate, this construction contains, unfortunately, low shear regions that can cause coating defects such "brush-like" along the edges of the deposited coated.

Figure 2:
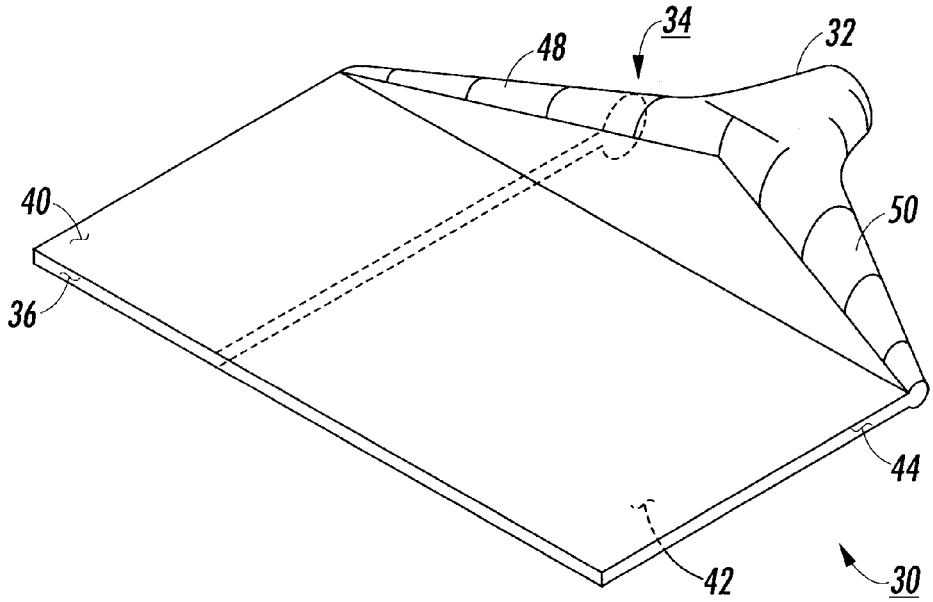
FIG. 2 is a schematic, isometric view of an extrusion system embodiment of this invention in which a ribbon-like stream of a coating composition is formed.

With reference to FIG. 2, an embodiment of an extrusion die of this invention is illustrated comprising die body 30. Die body 30 comprises a feed channel 32, a manifold 34, and an extrusion passageway 36 defined by flat upper land 40, flat lower land 42 and side plates 44. The leading edge of passageway 36 has a shallow inverted "V" or roof shape. Manifold 34 has a cavity which comprises a first progressively narrowing channel 48 and a second progressively narrowing channel 50. The manifold cavity, made up of channels 48 and 50, has a substantially circular cross section and is widest at the point where feed channel 32 joins cavity 46 and first progressively narrowing channel 48 and second progressively narrowing channel 50 extend away from at the point where feed channel 32 joins the manifold cavity. First progressively narrowing channel 48 and second progressively narrowing channel 50 each have a circular cross section and each have an imaginary axis which is straight. The expression "progressively" as employed herein is defined as a continuous narrowing of the cross section of the progressively narrowing channel immediately from the point where it connects with feed channel to the opposite free end of the progressively narrowing channel. Feed channel 32 also has a circular cross section and an imaginary axis which is straight. In the embodiment of FIG. 2, the free ends of imaginary axes of first progressively narrowing channel 48 and second progressively narrowing channel 50 are inclined toward extrusion passageway 36 and away from feed channel 32. In other words, the feed channel 32 has an imaginary axis and the imaginary axis of the first progressively narrowing channel 48 and the imaginary axis of the second progressively narrowing channel 50 extend outwardly away from the imaginary axis of the feed channel 32 and are also inclined toward the extrusion passageway 36. Thus, the joining of the imaginary axis of the first progressively narrowing channel 48 and the imaginary axis of the second progressively narrowing channel 50 to the imaginary axis of feed channel 32 forms a shallow "Y" shaped letter, the imaginary axis of feed channel 32 forming the vertical portion of the Y. The surfaces of flat upper land 40 and flat lower land 42 which define passageway 36 are spaced from and parallel to each other. The extrusion passageway 36 shapes the coating composition into a thin ribbon shaped stream for deposition as a coating on a substrate. The width, thickness, and the like of the ribbon-like stream extruded from passageway 36 can be varied in accordance with factors such as the viscosity of the coating composition, thickness of the coating desired, width of the substrate to be coated by the ribbon-like stream, and the like. The coating material is introduced into manifold 34 through feed channel 32. Feed channel 32 is positioned midway between the ends of manifold 34. Manifold 34 substantially uniformly distributes the coating material along the entire width of the entrance at the upstream end of extrusion passageway 36. Extrusion passageway 36 shapes the coating composition into a thin ribbon shaped stream which exits from the downstream end of the extrusion passageway 36. The ribbon shaped stream of coating material exiting from passageway 36 thereafter deposits on a substrate (not shown) to form a coating. The length of passageway 36 should be sufficiently long to ensure fully-developed laminar flow. A flat squared end is preferred for exit end of extrusion passageway 36. A flat outer lip surface appears to further support and stabilize the beads during extrusion coating operations. Control of the distance of exit end of passageway 36 from the substrate should be adjusted to enable the coating composition to bridge the gap between of exit end of passageway 36 and the substrate depending upon the viscosity, coating thickness, and rate of flow of the coating composition 28 and the relative rate of movement between die body 30 and the substrate. Generally, it is preferred to position the exit end of passageway 36 for lower viscosity ribbon-like streams closer to the support surface than wider extrusion slot outlets for higher viscosity ribbon-like streams to allow formation of a bead of coating material which functions as a reservoir for greater control of coating deposition.

Figure 3:
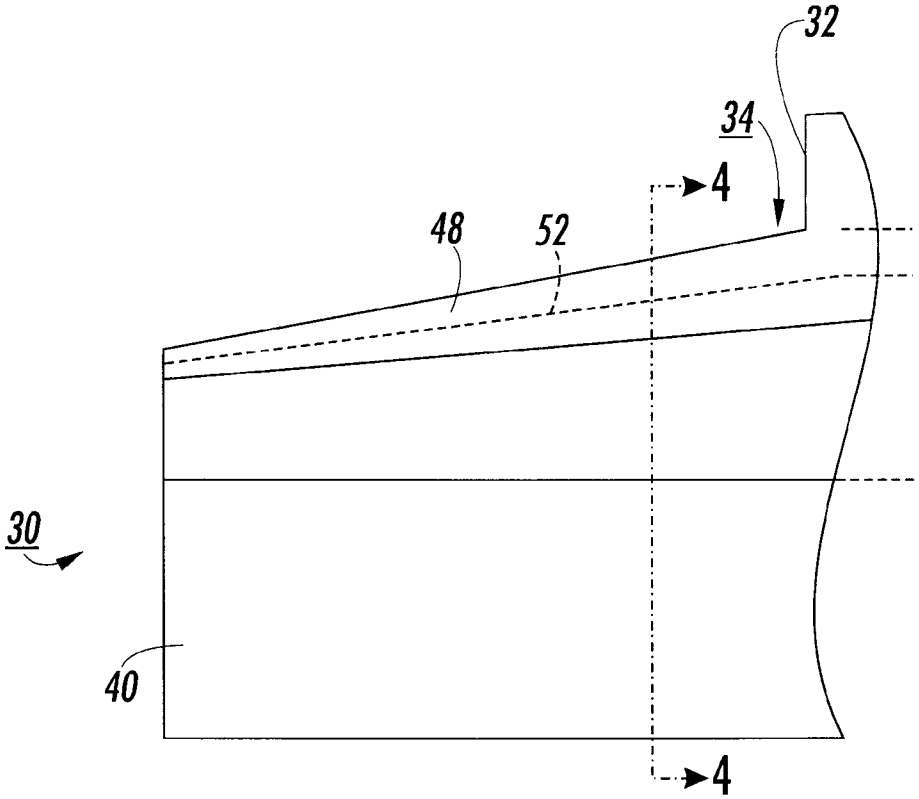
FIG. 3 is a simplified schematic, partial plan view of an extrusion system illustrated in FIG. 2.

Regarding FIG. 3, a simplified partial plan view is shown of the extrusion die of FIG. 2 comprising die body 30, feed channel 32, manifold 34, and flat upper land 40. First progressively narrowing channel 48 of manifold 34 is also illustrated along with an imaginary axis 52.

Figure 4:
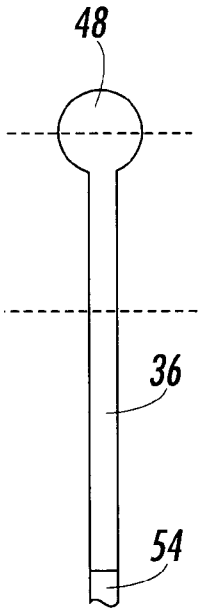
FIG. 4 is a simplified schematic, side view of the extrusion system illustrated in FIG. 3 viewed along 4—4.

Referring to FIG. 4, a cross section is shown of the embodiment of FIG. 3. First progressively narrowing channel 48 of manifold 34 has a substantially circular cross section. Also extrusion passageway 36 is shown with a thin ribbon-like extrudate 54 of coating material emerging from passageway 36.

Figure 5:
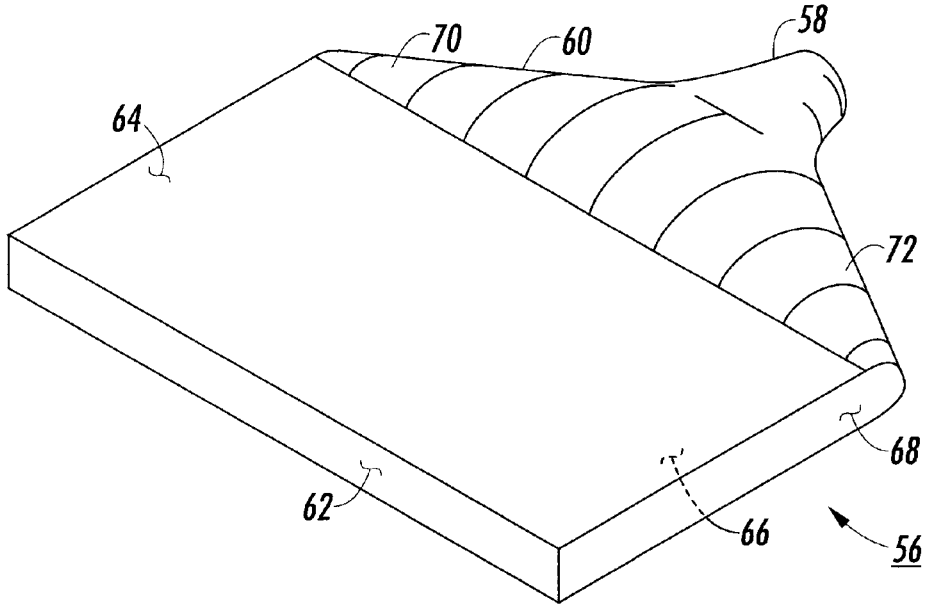
FIG. 5 is a schematic, isometric view of another embodiment of an extrusion system of this invention in which a ribbon-like stream of a coating composition is formed.

A variation of the embodiment of FIGS. 2, 3 and 4 is illustrated in FIG. 5. Die body 56 comprises a feed channel 58, a manifold 60, and an extrusion passageway 62 defined by flat upper land 64, flat lower land 66 and side plates 68. The surfaces of flat upper land 64 and flat lower land 66 which define passageway 62 are spaced from and parallel to each other. Manifold 60 has a cavity which comprises a first progressively narrowing channel 70 and a second progressively narrowing channel 72. The manifold cavity, made up of channels 70 and 72, has a substantially circular cross section and is widest at the point where feed channel 58 joins the manifold cavity and first progressively narrowing channel 70 and second progressively narrowing channel 72 extend away from at the point where feed channel 58 joins the manifold cavity. First progressively narrowing channel 70 and second progressively narrowing channel 72 each have a circular cross section and each have an imaginary axis which is straight. Feed channel 58 also has a circular cross section and an imaginary axis which is straight. Unlike the embodiment of FIGS. 2, 3 and 4, the imaginary axes of first progressively narrowing channel 70 and second progressively narrowing channel 72 are almost perpendicular to the imaginary axis of feed channel 58. In other words, feed channel 58 has an imaginary axis and the imaginary axis of the first progressively narrowing channel 70 and the imaginary axis of the second progressively narrowing channel 72 extend in an almost perpendicular direction outwardly from the imaginary axis of the feed channel. Thus, the joining of the imaginary axis of the first progressively narrowing channel 70 and the imaginary axis of the second progressively narrowing channel 72 to the imaginary axis of feed channel 58 almost forms a "T" shaped letter, the imaginary axis of feed channel 58 forming the vertical portion of the T. The leading edge of the entry way into passageway 62 is straight and parallel to the trailing edge of passageway 62.

Figure 6:
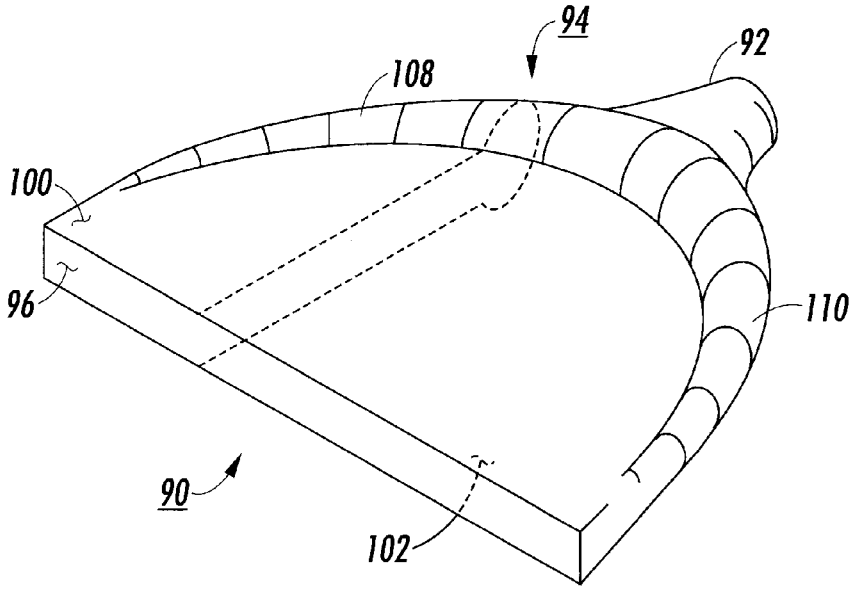
FIG. 6 is a schematic, isometric view of still another embodiment of an extrusion system of this invention in which a ribbon-like stream of a coating composition is formed.

With reference to FIG. 6, another variation of the die embodiment shown in FIG. 2 is shown where a die body 90 comprises a feed channel 92, a manifold 94, and an extrusion passageway 96 defined by flat upper land 100 and flat lower land 102. Manifold 94 has a cavity which comprises a first progressively narrowing channel 108 and a second progressively narrowing channel 110. The manifold cavity, made up of channels 108 and 110, has a substantially circular cross section and is widest at the point where feed channel 92 joins the manifold cavity and first progressively narrowing channel 108 and second progressively narrowing channel 110 extend away from at the point where feed channel 92 joins the manifold cavity. First progressively narrowing channel 108 and second progressively narrowing channel 110 each have a circular cross section and each have an imaginary axis which is curved. Feed channel 92 also has a circular cross section and an imaginary axis which is straight. Unlike the embodiment of FIG. 2, the free ends of imaginary axes of first progressively narrowing channel 108 and second progressively narrowing channel 110 are curved toward extrusion passageway 96 and away from feed channel 92. Thus, the feed channel 92 has an imaginary axis and the imaginary axis of the first progressively narrowing channel 108 and the imaginary axis of the second progressively narrowing channel 110 extend outwardly from the imaginary axis of the feed channel 32 and are also curved toward the extrusion passageway 96. Therefore, the joining of the curved imaginary axis of the first progressively narrowing channel 108 and the curved imaginary axis of the second progressively narrowing channel 110 to the imaginary axis of feed channel 92 forms a shape similar to a shallow letter "U" supported on top of the letter "I", the straight imaginary axis of feed channel 92 corresponding to the letter I. The curved shape of the first progressively narrowing channel 108 and the imaginary axis of the second progressively narrowing channel 110 should be smooth and continuous to prevent any abrupt change in direction of the flowing coating dispersion. Similarly the progressively narrowing of channels 108 and 110 should be smooth and continuous to prevent any abrupt change in direction of the flowing coating dispersion. Preferably the degree of curvature of channels 108 and 110 is developed by trial and error to achieve a stress on the coating liquid that is as uniform and low as possible.

Figure 7:
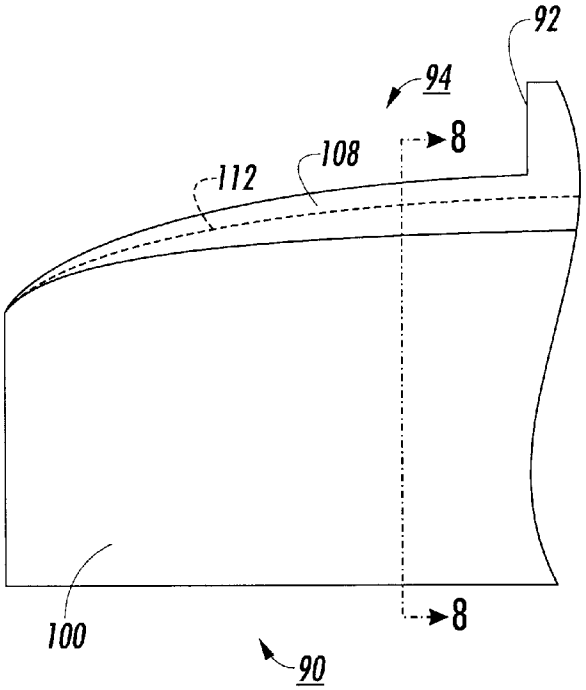
FIG. 7 is a simplified schematic, partial plan view of an extrusion system similar to that illustrated in FIG. 6.

Regarding FIG. 7, a simplified partial plan view is shown of the extrusion die of FIG. 6 comprising die body 90, feed channel 92, manifold 94 and flat upper land 100. First progressively narrowing channel 108 of manifold 94 is also illustrated along with an imaginary axis 112.

Figure 8:
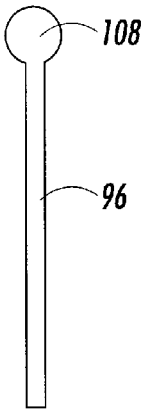
FIG. 8 is a simplified schematic, side view of the extrusion system illustrated in FIG. 7 viewed along 7—7.

Referring to FIG. 8, a cross section is shown of the embodiment of FIG. 7. First progressively narrowing channel 108 of manifold 94 has a substantially circular cross section. Also extrusion passageway 96 forms a thin ribbon-like extrudate similar to thin ribbon-like extrudate 54 of coating material emerging from passageway 36 shown in FIG. 4.

Figure 9:
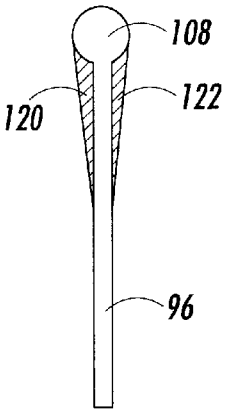
FIG. 9 is a simplified schematic, side view of a modified embodiment of the extrusion system illustrated in FIG. 8.

With reference to FIG. 9, a cross section is shown of an alternative embodiment of FIGS. 7 and 8. First progressively narrowing channel 108 of manifold 94 shown in FIGS. 7 and 8 has been machined to remove the region represented by the shaded areas 120 and 122 to form a new cross section resembling the silhouette of an ice cream cone or tear drop. This new cross section provides a more gradual transition zone as the coating material flows from the manifold 94 to the extrusion passageway 96 and further promotes laminar flow of the coating material through the die 90. Thus, it is clear that the cross section of the manifold may be of any suitable shape which facilitates laminar flow. Typical cross sectional shapes include, for example, round, oval, tear drop, half circle, square, and the like.

Figure 10:
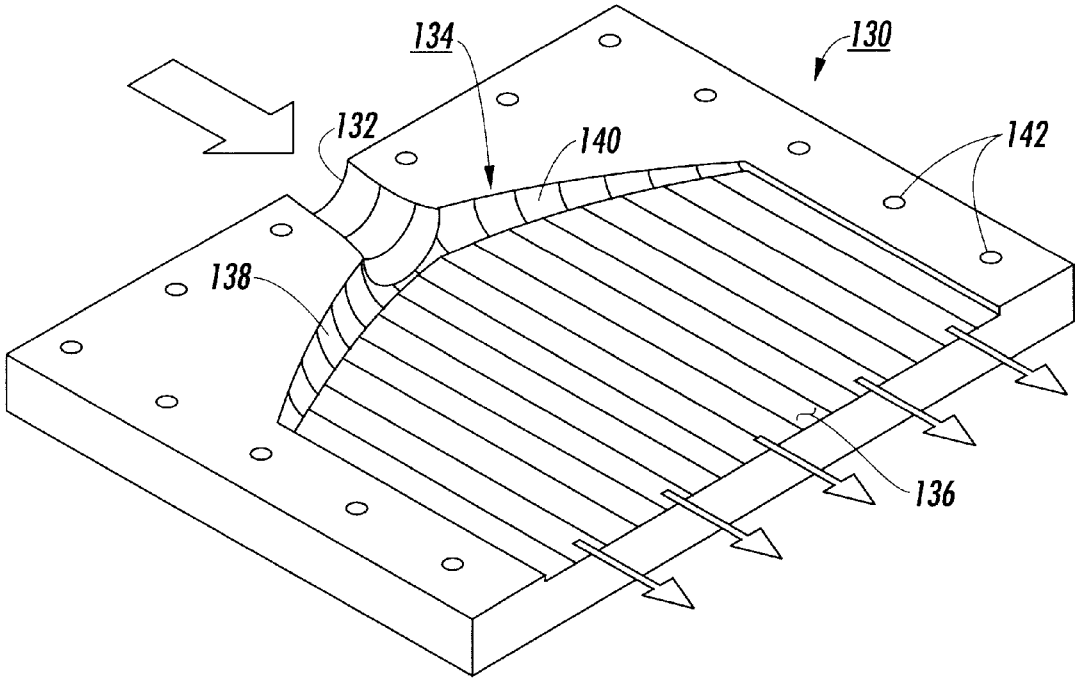
FIG. 10 is a simplified schematic, isometric view of the lower half of an extrusion system similar to that illustrated in FIG. 6.

Regarding FIG. 10, an isometric view of the lower half 130 of a die body shown including a feed channel half 132, a manifold cavity half 134, and an extrusion passageway partly defined by flat lower land half 136. Manifold half 134 comprises a cavity including a first progressively narrowing channel half 138 and a second progressively narrowing channel half 140. The manifold cavity half 134, made up of channel halves 138 and 140, has half of a tear drop shaped cross section and is widest at the point where feed channel half 132 joins the manifold cavity half 134 and first gressively narrowing channel half 138 and second progressively narrowing channel half 140 extend away from at the point where feed channel half 132 joins the manifold cavity. First progressively narrowing channel half 138 and second progressively narrowing channel half 140 each have a half of a tear drop shaped cross section and each have an imaginary centerline (not shown) which is curved away from the entry point of the coating dispersion from the feed channel to the manifold cavity and toward the exit of the extrusion passageway. Therefore, the joining of the curved first progressively narrowing channel half 138 and the curved second progressively narrowing channel half 140 to the feed channel half 132 forms a shape similar to a very shallow letter "U" supported on top of the letter "I", the straight imaginary axis of feed channel 92 corresponding to the letter I. The curved shape of the first progressively narrowing channel half 138 and the imaginary axis of the second progressively narrowing channel half 140 should be smooth and continuous to prevent any abrupt change in direction of the flowing coating dispersion. Similarly the progressively narrowing of channel halves 138 and 140 should be smooth and continuous to prevent any abrupt change in direction of the flowing coating dispersion. These shapes avoid the formation of vortices while simultaneously maintaining a wall shear stress greater than the yield stress of the coating dispersion. The lower half 130 of the die body contains bolt holes 142 to facilitate assembly to a mating upper half (not shown).

Figure 11:
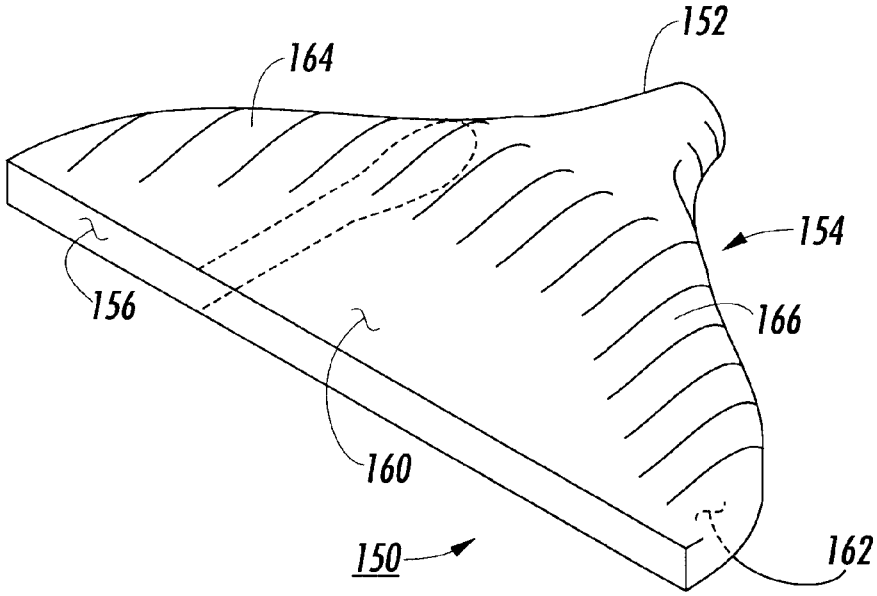
FIG. 11 is a schematic, isometric view of another extrusion system embodiment of this invention in which a ribbon-like stream of a coating composition is formed.

In regard to FIG. 11, still another die embodiment is illustrated where a die body 150 comprises a feed channel 152, a manifold 154, and an extrusion passageway 156 defined by flat upper land 160 and flat lower land 162. Manifold 154 has a cavity which comprises a first progressively narrowing channel 164 and a second progressively narrowing channel 166. The manifold cavity, made up of channels 164 and 166, has a tear drop shaped cross section and is widest at the point where feed channel 152 joins the manifold cavity and first progressively narrowing channel 108 and second progressively narrowing channel 110 extend away from at the point where feed channel 152 joins the manifold cavity. First progressively narrowing channel 164 and second progressively narrowing channel 166 each have a tear drop shaped cross section and each have an imaginary axis which is straight. Feed channel 152 also has a circular cross section and an imaginary axis which is straight. The imaginary axes of first progressively narrowing channel 164 and second progressively narrowing channel 166 are almost perpendicular to the imaginary axis of feed channel 152 and parallel to the leading or upstream edge of extrusion passageway 156. From a plan view perspective, each end of first progressively narrowing channel 164 and second progressively narrowing channel 166 and the sides of extrusion passageway 156 flair away from the axis of feed channel 152 along a curved path in the direction of the exit or downstream end of passageway 156. Thus, the combination of the feed channel 152, first progressively narrowing channel 164, second progressively narrowing channel 166, flat upper land 160 and flat lower land 162 form a die member having an outer shape similar in appearance to a "tail" of a fish.

Figure 12:
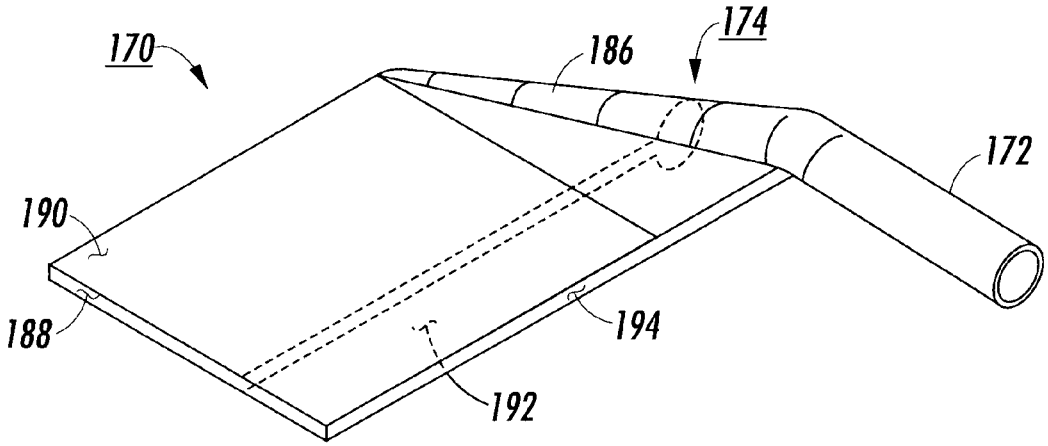
FIG. 12 is a schematic, isometric view of another embodiment of an extrusion system of this invention in which a ribbon-like stream of a coating composition is formed.

With reference to FIG. 12, still another embodiment of an extrusion die of this invention is illustrated. This embodiment is similar to approximately half of the die illustrated in FIG. 2. The die shown in FIG. 12 comprises die body 170. Die body 170 comprises a feed channel 172, a manifold 174, and an extrusion passageway 188 defined by flat upper land 190, flat lower land 192 and side plate 194. The leading edge of passageway 188 is angled slightly where it joins manifold 174. Manifold 174 has a cavity which comprises a first progressively narrowing channel 186 similar to channel 48 shown in FIG. 2, but does not comprise a second progressively narrowing channel such as channel 50 illustrated in FIG. 2. The manifold cavity, made up of channel 186, has a substantially circular cross section and is widest at the point where feed channel 172 joins the manifold cavity. The first progressively narrowing channel 186 extends away from the point where feed channel 172 joins the manifold cavity. First progressively narrowing channel 186 has a circular cross section and has an imaginary axis which is straight. Alternatively, the first set progressively narrowing channel can have a curved imaginary axis similar to that shown in FIG. 7. Feed channel 172 also has a circular cross section and an imaginary axis which is straight. In the embodiment of FIG. 12, the free end of the imaginary axis of first progressively narrowing channel 186 is inclined toward extrusion passageway 188 and away from feed channel 172. In other words, the imaginary axis of the first progressively narrowing channel 186 extends outwardly away from the imaginary axis of the feed channel 172 and is also inclined toward the extrusion passageway 188. Thus, the joining of the imaginary axis of the first progressively narrowing channel 186 and the imaginary axis of feed channel 172 forms a shallow "L" shaped letter, the imaginary axis of feed channel 172 forming one leg of the "L" and the imaginary axis of the first progressively narrowing channel 186 forming the other leg. The surfaces of flat upper land 190 and flat lower land 192 which define passageway 188 are spaced from and parallel to each other. The extrusion passageway 188 shapes the coating composition into a thin ribbon shaped stream for deposition as a coating on a substrate. The width, thickness, and the like of the ribbon-like stream extruded from passageway 188 can be varied in accordance with factors such as the viscosity of the coating composition, thickness of the coating desired, width of the substrate to be coated by the ribbon-like stream, and the like. The coating material is introduced into manifold 174 through feed channel 172. Feed channel 172 is positioned at the widest end of manifold 174. Manifold 174 substantially uniformly distributes the coating material along the entire width of the entrance at the upstream end of extrusion passageway 188. Extrusion passageway 188 shapes the coating composition into a thin ribbon shaped stream which exits from the downstream end of the extrusion passageway 188. The ribbon shaped stream of coating material exiting from passageway 188 thereafter deposits on a substrate (not shown) to form a coating. The length of passageway 188 should be sufficiently long to ensure fully-developed laminar flow. A flat squared end is preferred for exit end of extrusion passageway 188. A flat outer lip surface appears to further support and stabilize the beads during extrusion coating operations. Control of the distance of exit end of passageway 188 from the substrate should be adjusted to enable the coating composition to bridge the gap between of exit end of passageway 188 and the substrate depending upon the viscosity, coating thickness, and rate of flow of the coating composition and the relative rate of movement between die body 170 and the substrate. Generally, it is preferred to position the exit end of passageway 188 for lower viscosity ribbon-like streams closer to the support surface than wider extrusion slot outlets for higher viscosity ribbon-like streams to allow formation of a bead of coating material which functions as a reservoir for greater control of coating deposition.

Any suitable rigid material may be utilized for the extrusion die. Typical rigid materials include, for example, stainless steel, chrome plated steel, ceramics, or any other rigid metal or plastic capable of maintaining precise machining tolerances. Stainless steel and plated steel having a nickel plated intermediate coating and a chrome plated outer coating are preferred because of their long wear characteristics and capability of maintaining precise machining tolerances. The die body may comprise separate top and bottom sections. To achieve the extremely precise coating thickness profiles and exceptional surface quality requirements desired for electrophotographic imaging member coatings, the finish grinding of the dies should be accomplished consistently under high tolerance constraints across the entire die width, e.g. widths as high as 122 cm (48 inches).

Any suitable and conventional technique may be utilized to fabricate the dies of this invention. Typical fabrication techniques include, for example, milling, grinding, die cutting, laser ablation, molding, hand lapping, and the like. For convenience of manufacture, the die body may be formed, for example, by machining an upper section and a mirror image lower section (e.g. see FIG. 10). Preferably, the dies are machined to achieve the desired shape by using a programmable mill. The fabricated dies should be rigid. The interior surfaces of the slot or extrusion die should be as smooth as possible since uniformity of the coating thickness is closely related to mechanical accuracy of the slot surface, especially for narrow slots in photoreceptor coating.

The extrusion die may comprise multiple sections to facilitate fabrication of the die. For example, the extrusion may comprise a top half and a bottom half which are secured together by any suitable device. Typical examples of fastening devices include, machine screws inserted through holes in one section of the die and screwed into threaded holes in another mating section of the die; threaded studs mounted in threaded holes in one die section and extending through holes in another mating die section to receive nuts; set screws screwed into threaded holes in frame members or die body clamping flanges to press and clamp mating sections of the die together; and the like. Conventional alignment pins, shims and the like may also be employed, if desired. Typical fastening and alignment techniques are illustrated in U.S. Pat. No. 4,521,457 and U.S. Pat. No. 5,614,260, the entire disclosures thereof being incorporated herein by reference. If desired, adjustments to the crosssectional area of the extrusion slot as well as the manifold cavity of a multi section die may be accomplished by any suitable device such as shims, and the like.

As conventional in the art, the coating composition is supplied from any suitable reservoir (not shown) under pressure using a conventional pump or other suitable well known device such as a gas pressure system (not shown). Thus, any suitable device may be utilized to effect the flow of the coating material through the inlet into the manifold and out of the extrusion slot. Typical pump devices include, for example, gear pumps, centrifugal pumps, and the like. If desired, any suitable filter and mixing device may be employed to combine the coating material component and to strain out undesirable agglomerate particles and the like.

Preferably, the feed channel (inlet) to the manifold is positioned at about the midpoint between the two opposite ends of the extrusion die manifold cavity where the cavity progressively narrows from the midpoint to the two opposite ends. Alternatively, where the manifold progressively narrows form one end to the other, the feed channel is positioned at the widest end of the manifold cavity. Multiple inlets into the manifold are less desirably because such an arrangement may cause the formation of vortices in the manifold. The formation of vortices in the coating material as it passes through the extrusion die manifold is believed to be a source of the streaks formed on film of the final deposited charge generating layer coating containing the extruded dispersion of organic photoconductive particles in a solution of film forming binder in a solvent. Thus, these extrusion coating materials should be maintained under high shear stress conditions, which is higher than yield stress of the coating dispersion, without the formation of vortices during movement through the die manifold and the extrusion slot. All points within the coating dispersion flowing through the manifold are maintained under a shear stress greater than the substantially constant yield stress of the coating dispersion. In other words, the process of this invention comprises providing a coating dispersion comprising organic photoconductive particles in a solution of a film forming polymer in a solvent, the coating dispersion having a substantially constant yield stress value, flowing the coating dispersion through at least one progressively narrowing manifold in an extrusion die to form a ribbon-like extrudate, depositing the ribbon-like extrudate onto a substrate to form a coating and applying shear stress to the coating dispersion as it flows through the die, the shear stress being greater than the yield stress value of the coating dispersion. Optimally, the minimal wall shear stress is maintained greater than the dispersion yield stress so that no flocculations or aggregations of pigment particles appear in the manifold cavity, extrusion passageway, or slot during the coating operations. The minimal wall shear stress in the manifold and slot is the lowest shear stress on the wall of the manifold and slot. The shear stress is a well known term defined, for example in R. Byron Bird, R. C. Armstrong, and O. Hassager 1987 Dynamics of polymeric liquids, volume 1, fluid mechanics, John Wiley & Sons, New York.

In a more specific embodiment of this invention, the process comprises providing a coating composition comprising finely divided photoconductive organic particles dispersed in a solution of a film forming binder, flowing the composition along a feed channel, introducing the composition into an elongated manifold cavity comprising a least a first progressively narrowing channel extending away from the feed channel, flowing the coating composition along at least the first progressively narrowing channel, flowing the coating composition out of the manifold cavity into an extrusion passageway extending away from at least the first progressively narrowing channel, shaping the coating composition into a thin ribbon shaped stream in the extrusion passageway, depositing the ribbon shaped stream on a substrate to form a coating, and maintaining an applied shear stress to the composition that is greater than the yield shear stress value of the coating composition while flowing the composition through the at least first progressively narrowing channel and extrusion passageway.

Generally, for dispersions of organic photoconductive pigment particles in a solution of film forming binder material, the application of high shear stress to the coating material causes the material to flow faster, but the yield stress value remains substantially unchanged for any given dispersion of organic photoconductive pigment particles in a solution of film forming binder material. The expression "substantially unchanged" as employed herein is defined as varying less than about ±20 percent of the mean yield stress value in Pascal units. Some dispersions of organic photoconductive pigment particles in a solution of film forming binder material are thixotropic. Thixotropic dispersions are time dependent and, therefore, unlike dispersions of organic photoconductive pigment particles in a solution of film forming binder material, the yield stress value of thixotropic dispersions changes with time. Thus, for example, the yield stress value of a thixotropic dispersion may have a Pascal value of 0.26 when subjected to shear stress on one occasion can have a yield stress value of 0.42 Pascal when subjected to shear stress on the next occasion. Dispersions of organic photoconductive pigment particles in a solution of film forming binder material show little or no variation in yield stress value when subjected to shear stress applied on different occasions. Thus, for example the yield stress value of a dispersion of benzimidazole perylene particles in a solution of a film forming binder is between about 0.2 and about 0.6 Pascal. Although the yield stress of a dispersion of organic photoconductive particles changes with changes in the particle size and changes in the proportion of components (particles, binder and solvent), the yield stress value of a specific given dispersion changes very little from one moment in time to another much later point in time. The yield stress and shear stress for a given composition may be determined by any suitable technique. A typical technique involves the use of a stress rheometer.

The cross-sectional area of the inlet pipe is generally about the same as the cross-sectional area of the manifold where the inlet joins the manifold. The cross-sectional area of the inlet and the cross-sectional area of the outlet where the two join as well as the width and thickness of the extruded ribbon of coating material that exits the extrusion die depends upon the specific material and proportions thereof employed in the composition as while as the width and thickness of the extruded ribbon of coating material that is deposited onto a substrate to be coated. Also, the coating deposition rate is also a factor.

The imaginary centerline of the progressively constricted manifold or manifolds of the extrusion dies of this invention may extend in a straight line away from the feed inlet or extend along a curvilinearly tapered path in the general direction of the outlet slot of the die. The progressive constriction of the manifold in the direction away from the feed inlet need not be linear. Although the constricted cross-section of the manifold may eventually be constricted to a zero value at the end of the manifold furthest away from the feed inlet, the cross sectional area at an opposite end of a manifold cavity may have any suitable value greater than 0 so long as the manifold is progressively constricted in the direction away from the feed inlet. This arrangement ensures a coating material path within which the applied resistance and the coating residence time are substantially equal for the material introduced into the manifold. Thus, the progressively constricted cross-sectional area of the manifold or manifolds used in the process of this invention provide sufficient wall shear stress to the coating dispersion to prevent coating defects along the edges of a deposited coating. In other words, the coating dispersion flowing along the manifold in a direction away from the inlet is progressively constrained to maintain a shear stress on the dispersion contacting the manifold walls greater than the yield stress value of the dispersion. Thus, the cross-section of the manifold becomes progressively less, i.e. the manifold becomes more constricted, in a direction away from the feed inlet to ensure that the shear stress applied to the coating dispersion is always greater than the yield stress of the dispersion.

The selection of the degree of progressive narrowing of the first progressively narrowing channel and a second progressively narrowing channel (if a second progressively narrowing channel is employed) between the feed channel inlet and the extrusion passageway where the ribbon shaped stream or liquid sheet of coating dispersion is formed between the surfaces of a flat upper land and flat lower land, should be sufficient to maintain an applied shear stress on the coating dispersion greater than the yield stress value of the coating dispersion, the coating having a substantially constant yield stress value.

The die lip length varies with the specific coating materials and the proportions thereof employed as well as the slot width and height (determines thickness of ribbon-like extrudate) as well as the coating flow rate. Extrusion passageway (slot) width dimension, slot height, and the like generally depends upon factors such as the coating fluid viscosity, flow rate, distance to the surface of the support member, relative movement between the die and the substrate to be coated, the thickness of the coating desired, and the like. Generally, satisfactory results may be achieved with narrow passageway and exit slot heights between about 100 micrometers and about 750 micrometers in the main die and in the mini dies. It is believed, however, that heights greater than 750 micrometers will also provide satisfactory results. Good coating results have been achieved with slot heights between about 125 micrometers and about 250 micrometers. Optimum control of coating uniformity is achieved with slot heights between about 125 micrometers and about 200 micrometers. The roof, sides and floor of the narrow die passageway should preferably be parallel and smooth to ensure achievement of uniform laminar flow. The length of the narrow extrusion slot from the manifold to the outlet opening should be sufficient to ensure achievement of uniform laminar flow. Typical internal dimensions for an extrusion die includes a die width of about 346 millimeters, a feed channel (having a circular cross section diameter and imaginary centerline) of about 4.76 millimeters, a manifold cavity (having a circular cross section and imaginary centerline perpendicular to the imaginary centerline of the inlet) diameter of 4.76 millimeters at the inlet tapering to a diameter of 1.8 millimeters at the two opposite ends of the manifold cavity, a slot height of about 0.127 millimeters, and a slot width of 346 millimeters for a coating composition having a yield stress value of, for example, about 0.2–0.6 Pa.

Thus, to prevent coating defects in the final deposited charge generating layer coating with the process of this invention, the shear stress applied to the flowing coating in the extrusion die must be greater than the yield stress value of the coating composition during the period that the coating dispersion flows through the die. Preferably, the shear stress applied to the flowing coating in the extrusion die is at least about 0.5 Pascal greater than the yield stress value of the dispersion coating composition employed. Thus, for example, for a given organic photoconductive particle dispersion having a substantially constant yield stress of about 0.5 Pascal, the taper geometry of the manifold cavity and the slot cross section (e.g., area visible when peering into the open exit slot) of the extrusion passageway of the die is preferably selected so that the minimum wall shear stress applied to the flowing coating dispersion is greater than about 1 Pascal, compared to the average yield stress of 0.5 Pascal.

Satisfactory results are achieved with an applied shear stress of at least about 100 percent greater than the yield stress. Preferably, the applied shear stress is between about 30 and about 80 percent greater than the yield stress. By maintaining the shear stress higher than the yield stress, improved thickness uniformity of the deposited coating obtained and defects along the edges of the deposited coating are also avoided. The thickness uniformity is very important to the imaging quality capabilities of the final photoreceptor.

Generally, the substrate to be coated is a moving substrate and the extrusion die is normally stationary. However, if desired, the substrate can be maintained stationary and the extrusion die can be moved or both the substrate and the extrusion die can be moved to achieve relative motion between the extrusion die and the substrate. Relative speeds between the coating die assembly and the surface of the substrate up to about 100 feet per minute have been tested. However, it is believed that greater relative speeds may be utilized if desired. The relative speed should be controlled in accordance with the flow velocity of the ribbon-like stream of coating material.

The gap distance between the die outer lip surface adjacent the exit slot of the passageway and the surface of the substrate to be coated is determined by variables such as viscosity of the coating material, the velocity of the coating substrate and coating thickness. Generally speaking, a smaller gap is desirable for thinner coating thickness. Regardless of the technique employed, the flow rate and distance should be regulated to avoid splashing, dripping, puddling of the coating material. Typically, the exit slot of the die is normally positioned only about 125 micrometers to about 200 micrometers from the electrophotographic imaging member substrate during coating. Since, the slot coating is a premetered coating process, the coating thickness is determined by flow rate at the die inlet.

Generally, lower coating composition viscosities tend to form thinner wet coatings whereas coating compositions having high viscosities tend to form thicker wet coatings. Obviously, the thickness of a wet coating will be greater than the thickness of a dried coating.

Coating thickness uniformity is very sensitive to the power law index n. The power law model is the most widely used form of the general viscous constitutive relation. The power law index n characterizes shear thinning of the dispersion. When n=1, the dispersion is a Newtonian liquid, the viscosity is a constant. When n is smaller than 1, the dispersion is shear thinning, i.e. the viscosity of the dispersion decreases with increasing shear rate. For example, for a linearly-tapered die, the flow rate variation at the exit of the extrusion slot is ±1.4% where n=0.55 and ±0.5% for n=0.64, as predicted by modeling software for the die design. Surprisingly, coating thickness uniformity is not very sensitive to inlet flow rate. Similarly, uniformity does not appear very sensitive to viscosity magnitudes.

The pressures utilized to extrude the coating compositions through the narrow die passageway depends upon flow rate of the liquid, the size of the passageway and viscosity of the coating composition. Typically, the extrusion pressure applied to the dispersion of organic photoconductive particles dispersed in a solution of a film forming binder is between about 5 kPa and about 10 kPa to form a wet charge generating layer coating having a thickness of about 35 micrometers. This deposited wet charge generating layer forming a dry charge generating coating having a thickness of between about 1.6 micrometers and about 2.2 micrometers.

Any suitable temperature may be employed in the coating deposition process. Generally, ambient temperatures are preferred for deposition of solution coatings. However, higher temperatures may be desirable to facilitate more rapid drying of deposited coatings.

Any suitable charge generating layer coating composition comprising a dispersion of finely divided photoconductive organic particles in a solution of a film forming binder may be applied to a substrate with the slot or extrusion die of this invention. Generally, the coating composition comprises finely divided photoconductive organic particles dispersed in a solution of a film forming polymer dissolved in a liquid solvent for the polymer. Charge generating layer coating compositions comprising a dispersion of finely divided photoconductive inorganic particles normally extruded onto substrates during the fabrication of electrophotographic imaging members are well known in the art and described in the patent literature. If desired, the process of this invention be used to form a single layer photoreceptor, i.e. one that comprises photoconductive organic particles, film forming polymer and charge transport material in a single layer that can be used without a charge transport layer. The single layer photoreceptor coating composition should comprise a dispersion of photoconductive organic particles and film forming polymer dissolved in a solvent, the dispersion having a substantially constant yield stress.

Any suitable organic photoconductive particles may be utilized in the coating dispersions used in the extrusion process of this invention. The "organic photoconductive particles" useful in the process of this invention are pigments which form a dispersion in a solution of a film forming binder dissolved in a liquid solvent, the dispersion having a measurable substantially constant yield stress value. The yield stress value is considered measurable when the value is at least about 0.06 Pa with the current state-of-art rheometer. Typical organic photoconductive particles include, for example, various phthalocyanine pigments such as the X-form of metal free phthalocyanine, metal phthalocyanines such as hydroxy gallium phthalocyanine, titanyl phthalocyanine, vanadyl phthalocyanine and copper phthalocyanine; perylenes such as benzimidazole perylene; quinacridones; dibromo anthanthrone pigments; substituted 2,4-diamino-triazines; polynuclear aromatic quinones; and the like and mixtures thereof. Generally, the organic photoconductive pigment particles have an average particle size between about 0.2 micrometer and about 0.4 micrometer.

The yield stress of a typical benzimidazole perylene coating composition has a yield stress value of between about 0.2 and about 0.6 Pascal. The shear thinning value for a benzimidazole coating composition dispersion has a value of between about 0.4 and about 0.85 Power Law Index. The expression "shear thinning" as employed herein is defined as the shear viscosity decreasing with increasing shear rate. The expression "Power Law Index" is described above.

Any suitable film forming polymer soluble in a solvent may be used in the coating dispersion used in the process of this invention. Typical film forming polymers include, for example, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like.

Any suitable solvent may be utilized to dissolve the film forming polymer and form the coating dispersion. The solvent should not dissolve the organic photoconductive pigment particles and should be a solvent for the film forming binder. Typical solvents include, for example, methylene chloride, tetrahydrofuran, toluene, methyl ethyl ketone, isopropanol, methanol, cyclohexanone, heptane, other chlorinated solvents, and the like.

Any suitable proportion of organic photoconductive pigment particles, solvent and film forming binder may be employed to form the dispersion. Typical weight portions include about 1.4 to about 2 percent by weight organic photoconductive pigment particles, about 93 to about 94 percent by weight solvent and about 3.5 to about 5 percent by weight film forming binder, based on the total weight of the dispersion. The organic photoconductive, i.e. charge generation, particles can be present in the film forming binder matrix of the final dried coating in various amounts. Generally, from about 5 percent by volume to about 90 percent by volume of the organic photoconductive is dispersed in about 10 percent by volume to about 95 percent by volume of the film forming binder, and preferably from about 20 percent by volume to about 30 percent by volume of the organic photoconductive is dispersed in about 70 percent by volume to about 80 percent by volume of the film forming binder. The final dried charge generating layer generally ranges in thickness of from about 0.1 micrometer to about 5 micrometers, and preferably has a thickness of from about 0.3 micrometer to about 3 micrometers. The charge generation layer thickness is related to film forming polymer content. Higher film forming polymer content compositions generally require thicker layers for photogeneration. Thicknesses outside these ranges can be selected providing the objectives of the present invention are achieved. Drying of the deposited coating may be effected by any suitable conventional technique such as oven drying, infra red radiation drying, air drying and the like.

The extrusion process of this invention may be employed to coat the surface of support members of various configurations including webs, sheets, plates, and the like. The support member may be flexible, rigid, uncoated, precoated, as desired. The support members may comprise a single layer or be made up of multiple layers. The substrate may be insulating or conductive and, if desired, precoated with layers such as conductive layers, adhesive layers, charge blocking layers and the like. These layers are conventional and well known in the art of electrostatography and described for example in U.S. Pat. No. 4,265,990 and U.S. Pat. No. 4,439,507, the entire disclosures of these patents being incorporated herein by reference.

A charge transport layer may be formed on the charge generating layer formed by the extrusion coating process of this invention or, alternatively, the charge transport layer may be formed on the substrate prior to application of the charge generating layer formed by the extrusion coating process of this invention. The charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the charge generation layer from abrasion or chemical attack and therefor extends the operating life of the photoreceptor imaging member. The charge transport layer should exhibit negligible, if any, discharge when exposed to a wavelength of light useful in the electrostatographic process for which the photoreceptor is employed. Therefore, the charge transport layer is substantially transparent to radiation in a region in which the photoconductor is to be used. Thus, the active charge transport layer is a substantially non-photoconductive material which supports the injection of photogenerated holes from the generation layer. The charge transport layer in conjunction with the generation layer is a material which is an insulator to the extent that an electrostatic charge placed on the transport layer is not conducted in the absence of illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation layer and incapable of allowing the transport of these holes therethrough. This will convert the electrically inactive polymeric material to a material capable of supporting the injection of photogenerated holes from the generation layer and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multilayer-layer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like.

Any suitable and conventional technique may be utilized to mix and thereafter apply the charge transport layer coating mixture to the charge generation layer. Typical application techniques include spraying, dip coating, roil coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used provided that there are no adverse effects.

Other layers such as conventional ground strip layers, overcoating layers and anticurl backing layers may also be applied to the photoreceptor, if desired.

Thus, the process of this invention provides an improved process for extrusion coating of dispersion coating compositions to form a dried coating having a uniform thickness with fewer defects. Also, the process of this invention forms a photoreceptor which does not produce undesirable artifacts in the final electrophotographic copy.

PREFERRED EMBODIMENTS OF THE INVENTION

The invention will further be illustrated in the following non-limiting examples, it being understood that these examples are intended to be illustrative only and that the invention is not intended to be limited to the materials, conditions, process parameters and the like recited herein.

EXAMPLE I

The lower layers of an electrophotographic imaging member was fabricated by conventional techniques and materials to form on a thin titanium layer coated on a flexible polyester substrate film, a thin coating of a polysiloxane blocking layer having a thin polyester adhesive interface layer on the blocking layer.

The adhesive interface layer was thereafter extrusion or slot coated with a charge generation layer dispersion. This charge generation layer dispersion contained 1.75 percent by weight finely divided particles of benzimidazole perylene particles in a solution of 4 percent by weight of film forming binder dissolved in a solvent. The ratios of pigment: binder: solvent was 1.75:4:94.25. This dispersion had a yield stress value of about 0.4 Pascal as measured on a stress rheometer (Stress Tech, available from ATS RheoSystems). This yield stress value of this composition was substantially constant and changed very little from one moment in time to another much later point in time. This dispersion was applied to the blocking layer with the aid of an extrusion die similar to the die illustrated in FIG. 1. The coating gap was 127 micrometers, the inside diameter of the manifold was 4.76 millimeters, the length of the manifold measured from the centerline of the manifold intersection with the feed channel to one end of the manifold was 17.3 centimeters (total length of the entire manifold being 34.6 centimeters), and the flow rate was 240 cc/min. After drying in a forced air oven, the charge generation layer had a thickness of 2 micrometers. Examination of the resulting charge generation layer revealed defects resembling brush marks along each edge of the layer. These brush marks are believed to have been caused by the regions around two ends of the manifold where the wall shear stress is below the yield stress of the formation of vortices and turbulent flow of the charge generation layer dispersion as it flowed through the feed channel, the constant diameter manifold, and extrusion passageway. The calculated minimum wall shear stress in the manifold was 0.2 Pa, which was below the yield stress of the dispersion. A charge transport layer was then formed on the charge generation layer. The transport layer, after drying, contained 50 percent by weight N,N'-diphenyl-N, N'-bis(3-methylphenyl)-1,1'biphenyl-4-4'-diamine and 50 percent by weight polycarbonate resin (Makrolon 5705, available from Farbenfabriken Bayer A. G.) and had a thickness 24 micrometers. Examination of the resulting photoreceptor revealed that defects resembling brush marks in the charge generation layer along each edge showed through the deposited charge transport layer.

EXAMPLE II

The process described in Example I was repeated except that the charge generation layer was formed with the aid of an extrusion or slot coating die similar to the die illustrated in FIGS. 2–4. The coating gap was 127 micrometers, the inside diameter of the manifold at inlet was 4.76 millimeters, and the inside diameter at the two ends of the manifold was 1.8 millimeters, the length of the manifold measured from the manifold intersection with the centerline of the feed channel to one end of the manifold was 17.3 centimeters (total length of the entire manifold being 34.6 centimeters), and the flow rate was 240 cc/min. The calculated minimum wall shear stress was 1.3 Pa, which was greater than the yield stress of the dispersion, about 0.4 Pa. This relationship, where the minimum wall shear stress was greater than the yield stress of the dispersion, was maintained in the dispersion as it flowed through the manifold (first progressively narrowing channel and second progressively narrowing channel) and extrusion passageway. After drying in a forced air oven, the charge generation layer had a thickness of 2 micrometers. Examination of each edge of the resulting charge generation layer revealed a smooth surface free of any defects resembling brush marks along each edge of the layer. A charge transport layer identical to that described in Example I was then formed on the charge generation layer. Examination of each edge of the resulting transport layer revealed a smooth surface free of any defects resembling brush marks along each edge of the layer.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A coating process comprising providing a coating composition comprising finely divided photoconductive organic particles dispersed in a solution of a film forming binder, the composition having a predetermined substantially constant liquid yield stress value, flowing the composition through a feed channel, introducing the composition from the feed channel into an elongated manifold cavity comprising a least a first progressively narrowing channel extending away from the feed channel, flowing the coating composition through at least the first progressively narrowing channel, flowing the coating composition out of the manifold cavity into an extrusion passageway extending away from at least the first progressively narrowing channel, shaping the coating composition into a ribbon shaped stream in the extrusion passageway, depositing the ribbon shaped stream from the extrusion passageway onto a substrate to form a coating, and maintaining an applied shear stress to the composition that is greater than the yield shear stress value of the coating composition while flowing the composition through the at least first progressively narrowing channel and extrusion passageway.

2. A coating process according to claim 1 wherein the elongated manifold cavity comprises the first progressively narrowing channel and a second progressively narrowing channel, the first progressively narrowing channel and second progressively narrowing channel at least initially extending in opposite directions from the feed channel and progressively narrowing from the feed channel and including simultaneously flowing part of the coating composition through at least the first progressively narrowing channel and part of the coating composition through the second progressively narrowing channel, flowing the coating composition out of the manifold cavity into an extrusion passageway extending away from the first progressively narrowing channel and second progressively narrowing channel, shaping the coating composition into a ribbon shaped stream in the extrusion passageway, depositing the ribbon shaped stream from the extrusion passageway onto a substrate to form a coating, and maintaining an applied shear stress to the composition that is greater than the yield shear stress value of the coating composition while flowing the composition through the first progressively narrowing channel, second progressively narrowing channel, and extrusion passageway.

3. A coating process in accordance with claim 2 wherein the first progressively narrowing channel and second progressively narrowing channel each have an imaginary axis which is straight and which extends in opposite directions from the feed channel.

4. A coating process in accordance with claim 3 wherein the feed channel has an imaginary axis which is perpendicular to the imaginary axis of the first progressively narrowing channel and the imaginary axis of the second progressively narrowing channel.

5. A coating process in accordance with claim 3 wherein the feed channel has an imaginary axis and the imaginary axis of the first progressively narrowing channel and the imaginary axis of the second progressively narrowing channel extend outwardly from the imaginary axis of the feed channel and are also inclined toward the extrusion slot passageway.

6. A coating process in accordance with claim 2 wherein the first progressively narrowing channel and second progressively narrowing channel each have an imaginary axis which is curved and which extends along the length of the channel.

7. A coating process in accordance with claim 2 wherein the first progressively narrowing channel and second progressively narrowing channel each have an imaginary axis which extends along the length of the channel and which is curved in a direction toward the extrusion slot passageway.

8. A coating process in accordance with claim 2 wherein the progressively narrowing of the first and second progressively narrowing channels is linear.

9. A coating process in accordance with claim 2 wherein the progressively narrowing of the first and second progressively narrowing channels is smooth and continuous.

10. A coating process in accordance with claim 1 including maintaining the applied shear stress to the composition at least about 0.5 Pascal greater than the yield shear stress value of the composition.

11. A coating process in accordance with claim 1 wherein the finely divided photoconductive organic particles comprise hydroxygallium phthalocyanine particles.

12. A coating process in accordance with claim 1 wherein the finely divided photoconductive organic particles comprise benzimidazole perylene particles.

13. A coating process in accordance with claim 1 wherein the at least first progressively narrowing channel is a single progressively narrowing channel and this single progressively narrowing channel is the only progressively narrowing channel connected to the feed channel.

14. A coating process in accordance with claim 1 wherein the applied shear stress to the composition is at least about 100 percent greater than the yield shear stress value of the coating composition while flowing the composition through the at least first progressively narrowing channel and extrusion passageway.

15. A coating process in accordance with claim 1 wherein the applied shear stress to the composition is between about 30 percent and about 80 percent greater than the yield shear stress value of the coating composition while flowing the composition through the at least first progressively narrowing channel and extrusion passageway.

16. A coating process in accordance with claim 1 wherein the coating composition comprises from about 5 percent by volume to about 90 percent by volume of the photoconductive organic particles dispersed in about 10 percent by volume to about 95 percent by volume of the film forming binder.

17. A coating process in accordance with claim 1 wherein the coating composition comprises from about 20 percent by volume to about 30 percent by volume of the organic photoconductive organic particles dispersed in about 70 percent by volume to about 80 percent by volume of the film forming binder.

18. A coating process in accordance with claim 1 wherein the coating composition comprises about 1.4 percent to about 2 percent by weight photoconductive organic particles, about 93 percent to about 94 percent by weight solvent and about 3.5 percent to about 5 percent by weight film forming binder, based on the total weight of the coating composition.

19. A coating process comprising providing a coating composition dispersion comprising about 1.4 percent to about 2 percent by weight photoconductive organic particles, about 93 percent to about 94 percent by weight solvent and about 3.5 percent to about 5 percent by weight film forming binder, based on the total weight of the coating composition, the composition having a predetermined substantially constant liquid yield stress value, flowing the composition through a feed channel, introducing the composition from the feed channel into an elongated manifold cavity comprising a first progressively narrowing smooth and continuous channel and a second progressively narrowing smooth and continuous channel, the first progressively narrowing channel and second progressively narrowing channel at least initially extending in opposite directions from the feed channel and progressively narrowing from the feed channel and including simultaneously flowing part of the coating composition through at least the first progressively narrowing channel and part of the coating composition through the second progressively narrowing channel, flowing the coating composition out of the manifold cavity into an extrusion passageway extending away from the first progressively narrowing channel and second progressively narrowing channel, shaping the coating composition into a ribbon shaped stream in the extrusion passageway, depositing the ribbon shaped stream from the extrusion passageway onto a substrate to form a coating substantially free of defects resembling brush marks, and maintaining an applied shear stress to the composition that is between about 30 percent and about 80 percent greater than the yield shear stress value of the coating composition while flowing the composition free of vortices through the first progressively narrowing channel, second progressively narrowing channel, and extrusion passageway.

* * * * *